US009540967B2

(12) United States Patent
Kim et al.

(10) Patent No.: US 9,540,967 B2
(45) Date of Patent: Jan. 10, 2017

(54) SYSTEM AND METHOD FOR PREVENTING STICKING OF CONTINUOUS VARIABLE VALVE TIMING LOCKING-PIN

(71) Applicants: HYUNDAI MOTOR COMPANY, Seoul (KR); KIA MOTORS CORPORATION, Seoul (KR)

(72) Inventors: Hyun Kim, Hwaseong-si (KR); Sung Joo Kim, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 72 days.

(21) Appl. No.: 14/558,683

(22) Filed: Dec. 2, 2014

(65) Prior Publication Data

US 2016/0069230 A1 Mar. 10, 2016

(30) Foreign Application Priority Data

Sep. 4, 2014 (KR) ..... 10-2014-0117406

(51) Int. Cl.

| | |
|---|---|
| ***F01L 1/34*** | (2006.01) |
| ***F01L 9/04*** | (2006.01) |
| ***F01L 1/344*** | (2006.01) |

(52) U.S. Cl.

CPC ..... *F01L 9/04* (2013.01); *F01L 1/344* (2013.01); *F01L 2009/0496* (2013.01)

(58) Field of Classification Search

CPC ..... F01L 1/344; F01L 9/04; F01L 2009/0496
USPC ..... 123/90.15, 90.17
See application file for complete search history.

(56) References Cited

FOREIGN PATENT DOCUMENTS

| | | | |
|---|---|---|---|
| JP | 2000-170509 | A | 6/2000 |
| JP | 2002-168138 | A | 6/2002 |
| JP | 2002-227621 | A | 8/2002 |
| JP | 2005-264764 | A | 9/2005 |
| KR | 10-0506472 | B1 | 8/2005 |
| KR | 10-2010-0063465 | A | 6/2010 |
| KR | 10-2010-0126447 | A | 12/2010 |

OTHER PUBLICATIONS

Cole. et al., Valve Timing Control Apparatus and Method, US Patent Application Pub. No. US 2013/0000578 A1, Jan. 3, 2013.*

* cited by examiner

*Primary Examiner* — Ching Chang
(74) *Attorney, Agent, or Firm* — McDermott Will & Emery LLP

(57) ABSTRACT

A method of preventing sticking of a CVVT locking pin includes a condition determining step that determines whether a CVVT operation condition is satisfied, an locking-pin unlocking step that unlocks a locking-pin before the CVVT is operated, and a CVVT operating step that operates the CVVT, and a system for preventing sticking of a CVVT locking pin.

3 Claims, 4 Drawing Sheets

(Most advanced) (Parking) (Most retarded)

SYSTEM AND METHOD FOR PREVENTING STICKING OF CONTINUOUS VARIABLE VALVE TIMING LOCKING-PIN

CROSS-REFERENCE(S) TO RELATED APPLICATION

The present application claims benefit of priority to Korean Patent Application Number 10-2014-0117406 filed on Sep. 4, 2014, the entire contents of which application are incorporated herein for all purposes by this reference.

TECHNICAL FIELD

The present disclosure relates to continuous variable valve timing (CVVT), and more particularly to a method and a system for preventing sticking of a CVVT locking-pin which allows smooth unlocking of a locking-pin by optimizing operation control of a locking-pin and the CVVT in an intermediate phase CVVT system electronically controlling a locking-pin.

BACKGROUND

In general, a continuous variable valve timing (CVVT) system continuously changes opening/closing timings by changing the phase of a camshaft in accordance with the RPM of an engine and the load on a vehicle.

An automotive CVVT system 101 in the related art, as shown in FIG. 1, includes: a crank angle sensor that senses a rotational angle of a crankshaft; a cam angle sensor that senses a rotational angle of a camshaft 104; a variable valve timing unit 150 that is connected to a side of the camshaft 104 by a timing belt and advances or retards the camshaft 104; and an ECU that controls an oil control valve 108 on the basis of signals from the crank angle sensor and the cam angle sensor so that oil is supplied to an advancing chamber 111*a* or a retarding chamber 111*b* of the variable valve timing unit 150.

Further, the variable valve timing unit 150 is composed of a stator 110 that is connected by a timing belt to receive torque from the crankshaft and a rotor 120 that is integrally coupled to the camshaft 104, has a vane shape, and rotates with respect to the stator 110.

A main chamber 111 divided into the advancing chamber 111*a* and the retarding chamber 111*b* by the rotor 120 is defined in the stator 110, so when oil is supplied to the advancing chamber 111*a* through the oil control valve 108, a phase difference is generated between the rotor 120 and the stator 110 and the camshaft 104 is rotated, thereby changing the timing of a valve.

Obviously, when oil flows into the retarding chamber 111*b* through the oil control valve 108, a phase difference opposite to the phase difference described above is generated between the rotor 120 and the stator 110, thereby retarding the timing of the valve.

The CVVT system achieves an effect of improving fuel efficiency, reducing an exhaust gas, increasing low-speed torque, and improving output by optimizing the opening/closing timing of valves of an engine in accordance with the RPM of the engine, and an effect of improving fuel efficiency by reducing a pumping loss by increasing valve overlap of intake/exhaust valves. Further, it has an effect of reducing an exhaust gas by re-burning a non-burned gas due to an internal EGR by optimizing the valve overlap according to engine conditions and an effect of increasing low-speed torque and improving output by increasing volume efficiency through optimization of the intake valve timing according to engine conditions.

Recently, an intermediate phase CVVT system improving a limit in response and operation range of the existing CVVT system has been actively developed.

FIG. 2 shows a most advance position, a parking position, and a most retard position of a cam in the intermediate phase CVVT system. The intermediate phase CVVT system, unlike the existing CVVT system, controls the position of a cam not at the most advance (intake) and most retard (exhaust) positions, but at a middle fixed position, so response is quick and the use range (operation range) of the cam can be increased, and accordingly, the fuel efficiency is improved and the exhaust gas is reduced.

However, the intermediate phase CVVT system has complicated internal channels and is required to precisely control an OCV (oil channel control valve).

In particular, as in FIG. 2, the CVVT electronically controls a locking-pin (solenoid ON/OFF control) through a separate solenoid valve in order to mechanically park a cam at the parking positions, except the area controlled in the advance/retard direction, in which when locking/unlocking of the locking-pin fails to be controlled, the locking-pin cannot be unlocked, so the CVVT cannot operate, and the locking-pin cannot be locked, the cam is oscillated.

That is, when a locking-pin cannot be locked/unlocked in an electronically controlled intermediate CVVT system, the CVVT fails to operate and the cam position at the parking position is oscillated, so response may be deteriorated, drivability may become poor, then engine may stop, and the engine may not start.

However, when the locking-pin fails to be locked, it is physically locked when cam torque and spring force become equilibrium in CVVT, so that the problem that the locking-pin fails to be locked due to cam torque can be solved by increasing the spring force, but the problem that the locking-pin is unlocked cannot be solved while the engine operates.

For example, an ECU controls a locking-pin in response to an electric signal from a solenoid valve, and it necessarily takes time to release the locking-pin (solenoid valve) by applying electricity to the solenoid valve.

However, when oil is supplied to a CVVT hydraulic circuit and the CVVT operates first, before the locking-pin is unlocked, the problem of locking of the locking-pin 1 is generated, as in FIG. 3, so that the locking-pin 1 is physically stuck and cannot be released.

SUMMARY

The present disclosure provides a method and a system for preventing sticking of a continuous variable valve timing locking-pin which allows smooth unlocking of a locking-pin by optimizing operation control of a locking-pin and CVVT in an intermediate phase CVVT system electronically controlling a locking-pin.

In one aspect, the present invention provides a method of preventing sticking of a CVVT locking pin which includes: a condition determining step that determines, by a determiner, whether a CVVT operation condition is satisfied; a locking-pin unlocking step that unlocks, by a controller, a locking-pin before the CVVT is operated; and a CVVT operating step that operates, by the controller, the CVVT.

The locking-pin unlocking step may unlock the locking-pin by applying an electric signal to a solenoid valve for operating the locking-pin.

The locking-pin unlocking step may further include an unlocking determining step that determines, by the determiner, whether the locking-pin is fully unlocked, by comparing the time when an electric signal is applied to the solenoid valve with a standard value.

The unlocking determining step may determine, by the determiner, that the locking pin has been fully unlocked, when a time lapsing from the point of time when an electric signal to the solenoid valve is larger than a standard value.

In another aspect of the present disclosure, a system for preventing sticking of a CVVT locking pin includes: a determiner that determines whether a CVVT operation condition is satisfied; and a controller that unlocks the locking-pin before the CVVT is operated and then operates the CVVT, when the CVVT operation condition is satisfied.

The system may further include: a storage that stores a standard value for determining whether the locking-pin has been fully unlocked; and a calculator that measures a time lapsing from time when an electric signal is applied to the solenoid valve for unlocking the locking-pin and compares the time lapsing from the time when the electric signal is applied to the solenoid valve with a standard valve, in which the determiner may determine that the locking-pin has been fully unlocked, when the time lapsing from the point of time when an electric signal is applied to the solenoid valve is larger than the standard value.

In another aspect of the present disclosure, a system for preventing sticking of a CVVT locking pin includes: a controller that determines whether a CVVT operation condition is satisfied, and unlocks the locking-pin before the CVVT is operated and then operates the CVVT, when the CVVT operation condition is satisfied.

BRIEF DESCRIPTION OF THE DRAWINGS

The above and other features of the present inventive concept will now be described in detail with reference to exemplary embodiments thereof illustrating the accompanying drawings which are given herein below by way of illustration only, and thus are not limitative of the present invention, and wherein.

Figure 1:
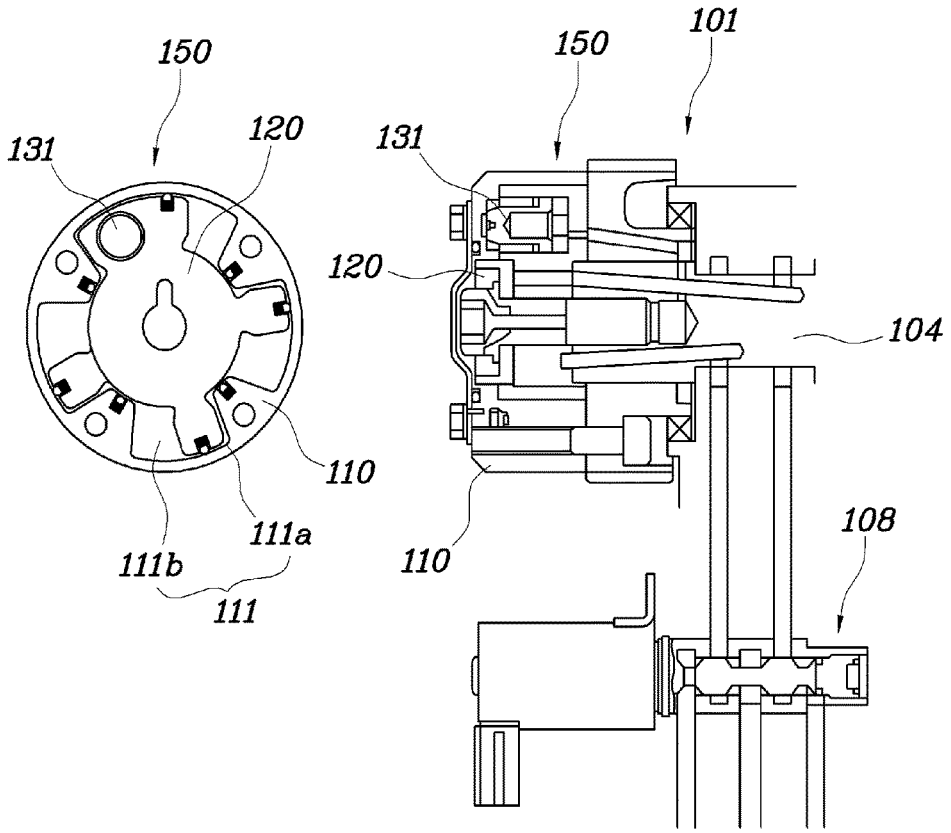
FIG. 1 Related Art
FIG. 1 is a view showing the configuration of a CVVT according to the related art.
Figure 2:
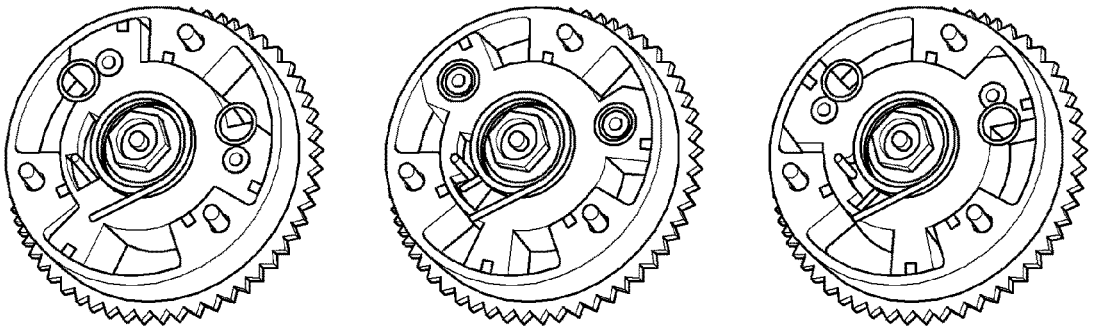
FIG. 2 Related Art
FIG. 2 is a view showing fixed states at a most advance position, a parking position, a most retard position in an intermediate phase electronic control CVVT system according to the related art.
Figure 3:
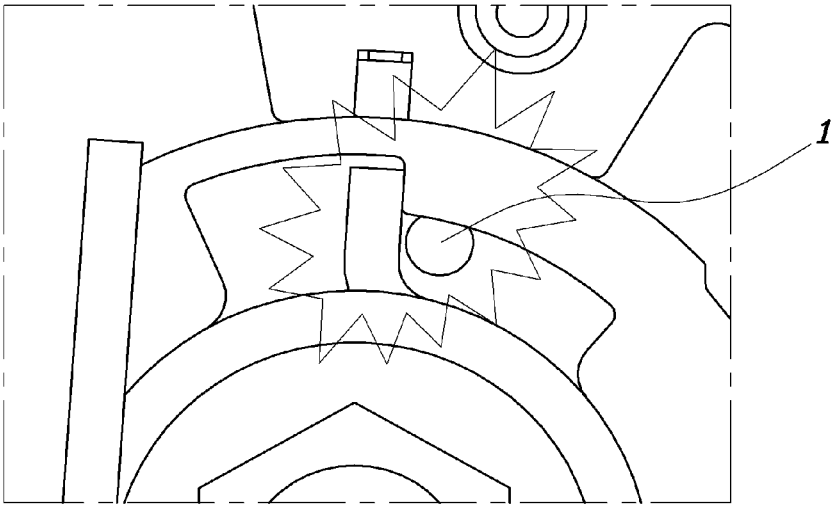
FIG. 3 Related Art
FIG. 3 is a view illustrating the state when a locking-pin is fixed by pre-operation of CVVT in an intermediate phase electronic control CVVT system of the related art.

It should be understood that the appended drawings are not necessarily to scale, presenting a somewhat simplified representation of various preferred features of the present inventive concept as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Hereinafter reference will now be made in detail to various embodiments of the present invention, examples of which are illustrated in the accompanying drawings and described below. While the inventive concept will be described in conjunction with exemplary embodiments, it will be understood that the present description is not intended to limit the invention to those exemplary embodiments. On the contrary, the invention is intended to cover the exemplary embodiments as well as various alternatives, modifications, equivalents and other embodiments; which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Preferred embodiments of the present invention will be described hereafter in detail with reference to the accompanying drawings.

A method of preventing sticking of a CVVT locking-pin of the present disclosure includes a condition determining step (S10), a locking-pin unlocking step (S20), and a CVVT operating step (S30).

Figure 4:
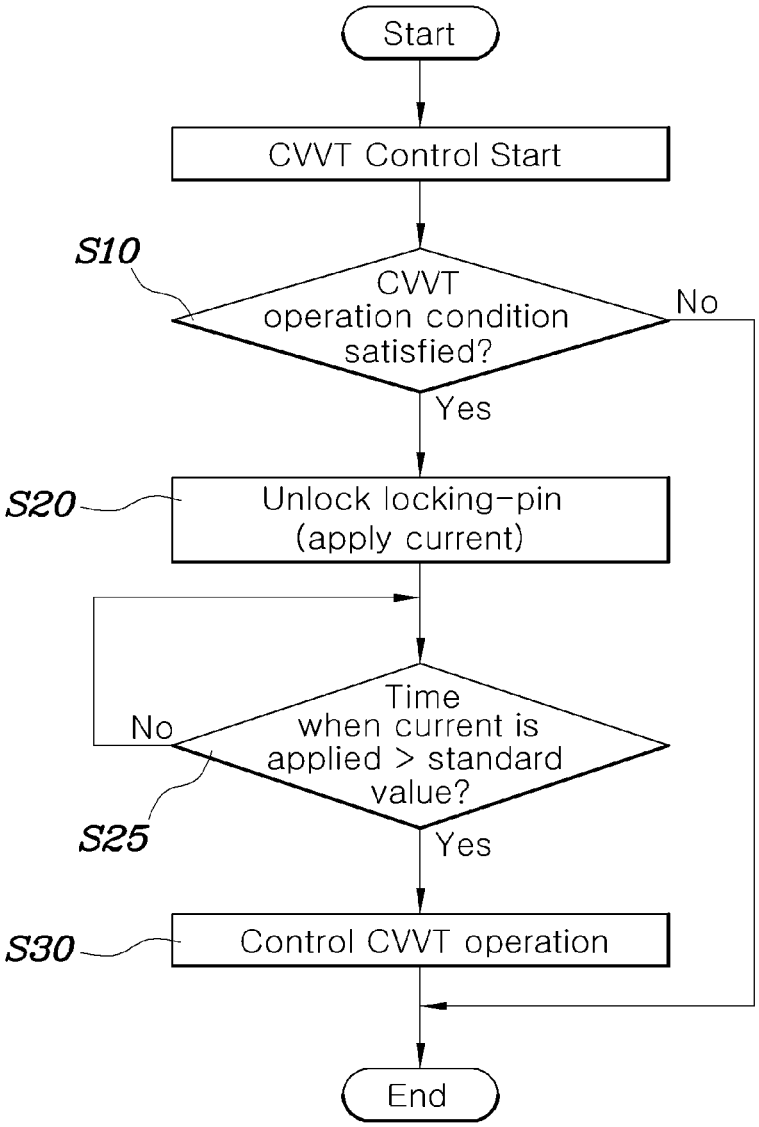
FIG. 4 is a flow chart showing a method of preventing sticking of a CVVT locking-pin according to the present disclosure.

The present disclosure is described in detail with reference to FIG. 4. In the condition determining step (S10) t, whether CVVT operation conditions are satisfied is determined by a determiner 10.

For example, when a need exists for adjusting valve timing of intake/exhaust valves in accordance with engine conditions such as the RPM of an engine, an ECU electronically controls the CVVT to operate and it is possible to determine whether a condition for operating the CVVT is satisfied in accordance with the engine conditions.

In the locking-pin unlocking step (S20), a locking-pin is unlocked first before the CVVT is operated by a controller 20, when it is determined that a CVVT operation condition is satisfied in the condition determining step (S10).

For example, unlocking of the locking-pin means unlocking the locking-pin from a stator rotating with a camshaft and the locking-pin can be locked and unlocked by On/Off of a solenoid valve.

Accordingly, when an electric signal is applied to a solenoid valve to unlock the locking-pin, the locking-pin is unlocked from the stator.

After the locking-pin unlocking step (S20), CVVT is operated by the controller 20 in the CVVT operating step (S30). For example, the CVVT may also be operated through the solenoid valve, and when oil is supplied to a CVVT hydraulic circuit, the CVVT can be operated.

According to this configuration, after the ECU unlocks the locking-pin, the CVVT is controlled to operate, so that it is possible to solve the problem that a locking-pin cannot be unlocked due to pre-operation of the CVVT, when the CVVT is operated. Accordingly, it is possible to solve the problem such as deterioration of response, deterioration of drivability, stopping of an engine, and poor starting of an engine due to poor unlocking of a locking-pin.

The present inventive concept may further include an unlocking step (S25) that checks whether the locking-pin has been fully unlocked, after unlocking of the locking-pin.

For example, in the unlocking step (S25), it is determined by the determiner 10 whether the locking-pin has been fully unlocked by comparing time for which an electric signal is applied to the solenoid valve with a standard valve (standard time), after the unlocking step (S20).

As a preferred embodiment, when the time passing from the point of time when an electric signal is applied to the solenoid valve is larger than the standard value, it may be possible to determine by the determiner 10 that the locking pin has been fully unlocked.

That is, by comparing the operation lapse time of the solenoid valve for unlocking the locking-pin, the CVVT is operated after time for unlocking the locking-pin is provided, so the possibility of sticking of the locking-pin due to pre-operation of the CVVT is more certainly prevented.

However, the standard valve (standard time) should be optimized to a minimum time through a test for quick operation of CVVT.

However, a system of preventing CVVT locking of the present disclosure includes a determiner 10 and a controller 20.

Figure 5:
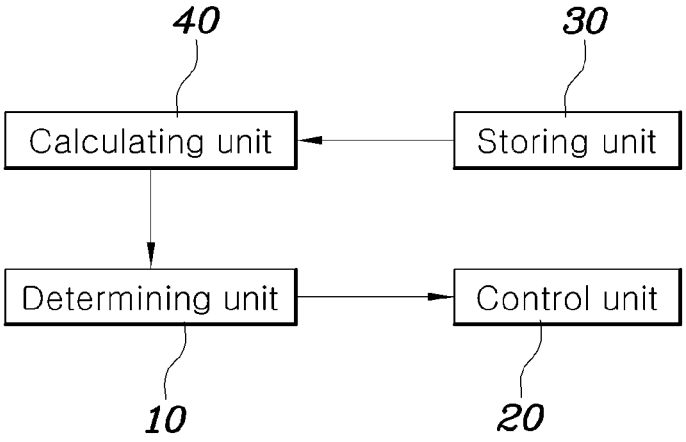
FIG. 5 is a view showing a system for preventing sticking of a CVVT locking-pin according to the present disclosure.

Referring to FIG. 5, the determiner 10 determines whether a CVVT operation condition is satisfied.

Further, the controller 20 unlocks the locking-pin before the CVVT is operated, and then operates the CVVT, when the CVVT operation condition is satisfied.

That is, after the ECU unlocks the locking-pin, the CVVT is controlled to operate, so that it is possible to solve the problem of sticking of a locking-pin due to pre-operation of the CVVT, when the CVVT is operated. Accordingly, it is possible to solve the problem such as deterioration of response, deterioration of drivability, stopping of an engine, and poor starting of an engine due to poor unlocking of a locking-pin.

Further, the present invention may further include a storage 30 and a calculator 40.

For example, the storage 30 keeps a standard value for determining whether the locking-pin has been fully unlocked.

Further, calculator 40 measures a time lapsing from the point of time when an electric signal is applied to a solenoid valve for unlocking the locking-pin and compares the time lapsing from the point of time when the electric signal is applied to the solenoid valve with the standard value.

Accordingly, the determiner 10 determines that the locking-pin has been fully unlocked, when the time lapsing from the point of time when an electric signal is applied to the solenoid valve is larger than the standard value.

The system for preventing sticking of a CVVT locking-pin of the present disclosure may be implemented by one controller and the controller may be an ECU.

Further, when the CVVT operation condition is satisfied as a result of determining whether the CVVT operation condition is satisfied, the controller unlocks the locking-pin before the CVVT is operated, and then operates the CVVT.

After the locking-pin is unlocked, the CVVT is controlled to operate, so that it is possible to solve the problem of sticking of a locking-pin due to pre-operation of the CVVT, when the CVVT is operated. Accordingly, it is possible to solve the problem such as deterioration of response, deterioration of drivability, stopping of an engine, and poor starting of an engine due to poor unlocking of a locking-pin.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A method of preventing sticking of a CVVT locking-pin, the method comprising:

a condition determining step that determines, by a determiner, whether a CVVT operation condition is satisfied in accordance with an engine condition;

a locking-pin unlocking step that unlocks, by a controller, the CVVT locking-pin which is installed to a CVVT by applying an electric signal to a solenoid valve before the CVVT is operated;

an unlocking determining step that determines, by the determiner, whether the CVVT locking-pin has been fully unlocked, by comparing a time lapsing from a point of time when an electric signal is applied to the solenoid valve with a standard value; and a CVVT operating step that operates, by the controller, the CVVT when the CVVT locking-pin has been fully unlocked.

2. The method of claim 1, wherein the unlocking determining step determines, by the determiner, that the CVVT locking-pin has been fully unlocked, when the time lapsing from the point of time when the electric signal to the solenoid valve is larger than the standard value.

3. A system for preventing sticking of a CVVT locking-pin, comprising:

a determiner that determines whether a CVVT operation condition is satisfied in accordance with an engine condition;

a controller that unlocks the CVVT locking-pin which is installed to a CVVT by applying an electric signal to a solenoid valve before the CVVT is operated when the CVVT operation condition is satisfied;

a calculator that measures a time lapsing from a point of time when the electric signal is applied to the solenoid valve for unlocking the CVVT locking-pin, and compares the time lapsing from the time when the electric signal is applied to the solenoid valve with a standard value; and a storage that stores the standard value for determining whether the CVVT locking-pin has been fully unlocked, wherein the determiner determines that the CVVT locking-pin has been fully unlocked, when the time lapsing from the point of time when the electric signal is applied to the solenoid valve is larger than the standard value, and wherein the controller operates the CVVT when the CVVT-locking pin has been fully unlocked.

* * * * *